United States Patent [19]

McCrackin et al.

[11] Patent Number: 4,848,838

[45] Date of Patent: Jul. 18, 1989

[54] CURVED ARTICULATING HEADREST SUPPORT BAR

[75] Inventors: Hugh J. McCrackin, Pineville; Dennis F. Leffler, Charlotte, both of N.C.

[73] Assignee: Pelton & Crane Company, Charlotte, N.C.

[21] Appl. No.: 285,185

[22] Filed: Dec. 15, 1988

Related U.S. Application Data

[63] Continuation-in-part of Ser. No. 233,966, Aug. 18, 1988, which is a continuation of Ser. No. 164,164, Mar. 4, 1988, abandoned.

[51] Int. Cl.[4] ..... A47C 7/10

[52] U.S. Cl. ..... 297/391; 297/61; 297/408; 297/409

[58] Field of Search ..... 297/408, 409, 391, 430, 297/61, 68

[56] References Cited

U.S. PATENT DOCUMENTS

| | | | |
|---|---|---|---|
| 171,664 | 1/1876 | Grems et al. | 297/408 |
| 326,184 | 9/1885 | White | 297/408 X |
| 3,057,657 | 10/1962 | Fletcher | 297/61 |
| 3,817,576 | 6/1974 | Ciavattoni et al. | 297/408 |
| 4,353,595 | 10/1982 | Kaneko et al. | 297/408 |
| 4,413,858 | 11/1983 | Beach | 297/391 X |
| 4,511,180 | 4/1985 | Klaus | 297/408 |
| 4,515,406 | 5/1985 | Fujiyama et al. | 297/409 |
| 4,647,108 | 3/1987 | Hayashi | 297/391 |
| 4,674,797 | 1/1987 | Tateyama | 297/408 |
| 4,761,034 | 8/1988 | Saito | 297/408 |

FOREIGN PATENT DOCUMENTS

| | | |
|---|---|---|
| 2541506 | 3/1977 | Fed. Rep. of Germany . |
| 2932344 | 2/1981 | Fed. Rep. of Germany . |
| 3048688 | 9/1981 | Fed. Rep. of Germany . |

OTHER PUBLICATIONS

Thesis of Albrecht Baumann entitled "Entwurf einer motorisch bewegten . . . " presented to the Institut Fur Arbeitswissenschaft Technische Hochschule Darmstadt on Aug. 4, 1986.

*Primary Examiner*—James T. McCall

*Attorney, Agent, or Firm*—Lawrence C. Edelman

[57] ABSTRACT

A headrest tilting mechanism includes a curved bar having first and second ends, with a headrest mounting portion proximate the first end and a cam following means proximate the second end. A support means includes a curved cam surface which is engaged by said cam following means, and a pin. The pin slidably engages a portion of the bar which is intermediate the first and second ends so as to allow said bar to be slidable with respect to said support means. The cam following means causes the second end to follow the cam surface of the support means when said bar is slid with respect to said support means. With this arrangement, the curved cam surface is not located at the very top of the chair back and therefore the head of the patient can be significantly closer to the lap of the dentist than prior art arrangements. Furthermore, due to the curvature of the bar, the degree of curvature of the cam following surface can be reduced.

20 Claims, 4 Drawing Sheets

CURVED ARTICULATING HEADREST SUPPORT BAR

CROSS-REFERENCE TO RELATED APPLICATIONS

This is a Continuation-in-part of Ser. No. 233,966, filed Aug. 18, 1988, which is a Continuation of Ser. No. 164,164, filed Mar. 4, 1988, now abandoned.

BACKGROUND OF THE INVENTION

1. Field of the Invention

This invention relates to an articulated headrest for a treatment chair, and more particularly to a mechanism for controlling the tilting angle of the headrest of a dental treatment chair.

2. Description of the Prior Art

FIG. 1(A) indicates one type of prior art headrest mechanism for a dental chair wherein a headrest 2 includes a pad 4 fixedly attached to one end of a support bar 6, the other end of bar 6 being pivotably attached to the backrest 8 of the treatment chair via a coupling 10. The locus of rotation A of headrest 2 has a center of rotation C centered at coupling 10 while the locus of rotation B of the head H of a patient P has a center of rotation C' corresponding with the cervical vertebrae of the patient P when positioned in the treatment chair. Since the center of rotation for headrest 2 does not match the center of rotation for head H, head H will physically slip out of position on pad 4 during adjustment of the tilt of headrest 2. This results in patient discomfort and a necessary repositioning of the posture of patient P.

FIG. 1(B) indicates another prior art headrest arrangement, such as known for example by U.S. Pat. No. 4,515,406, wherein the headrest mechanism 12 includes a pad 14 fixedly attached to a straight portion 16 of a generally curved support bar 18. The curved portion of support bar 18 rides between rollers 20 located within the backrest 22 of the dental chair and is thereby adjustable along the length of support bar 18 for controlling the tilting of the head H of the patient P. A locking ratchet arrangement 24 is included within backrest 22 and engages support bar 18 for locking it into a desired position. Note that in this arrangement the locus of rotation A of headrest pad 14 has a center of rotation C" which is also the center of rotation of the head H of the patient P. Although this arrangement solves the problem shown in FIG. 1(A) of the head slipping off the headrest pad during adjustment of the tilting angle by having identical positions for origins C and C', a disadvantage of this arrangement is that the curvature of support bar 18 prevents a significant lowering of the patient's head into the lap of the dentist since the curvature of support bar 18 is located at the top of the chair backrest. Thus, advantageous positioning of the head H of the patient P toward the lap of the dentist is limited thereby.

An object of the present invention is to provide an adjustable headrest for a treatment chair which is comfortable for the patient both during and after a readjustment of the tilting of the patient's head and which improves the ability of the headrest to be lowered toward the lap of the dentist.

SUMMARY OF THE INVENTION

In accordance with the principles of present invention, these objects are achieved by a mechanism which moves that portion of the headrest which defines its locus of rotation from the top of the chair backrest, to a position located lower in the backrest. More specifically, a curved bar is provided having first and second ends, with a headrest mounting portion proximate the first end and a cam following means attached thereto proximate the second end. A support means attached to the backrest includes a curved cam surface which is engaged by the cam following means, and a guide means. The guide means slidably engages a portion of the bar which is intermediate the first and second ends so as to allow the bar to be slidable with respect to the support means. The cam following means causes the second end of the bar to follow the cam surface of the support means when the bar is slid with respect to the support means. With this arrangement, the curved cam surface is not located at the very top of the chair back and therefore the head of the patient can be significantly closer to the lap of the dentist than with the prior art arrangements. Furthermore, due to curvature of the bar, the degree of curvature of the cam surface can be reduced, thereby further reducing the thickness of the backrest.

Other features and advantages of the invention will be apparent from the description of the preferred embodiment, and from the claims.

For a fuller understanding of the present invention, reference should now be made to the following detailed description of the preferred embodiment of the invention and to the accompanying drawings.

DETAILED DESCRIPTION OF THE PREFERRED EMBODIMENTS

Figure 1A:
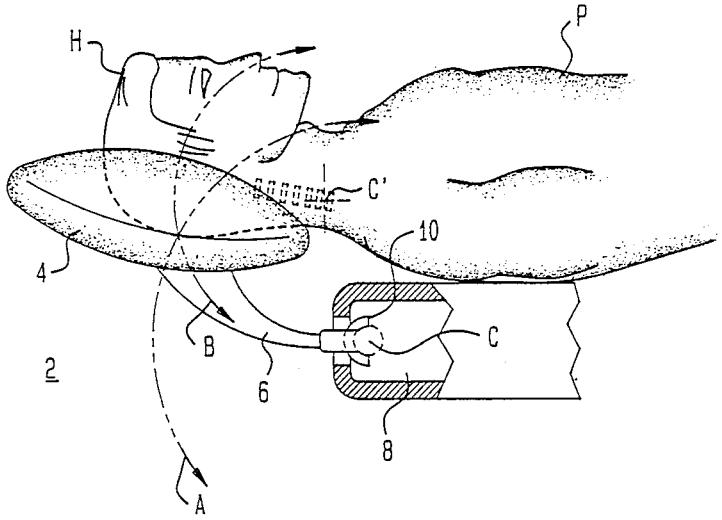
FIG. 1A (PRIOR ART)
FIGS. 1(A) and 1(B) show cross-section views of prior art headrest arrangement, previously described.
Figure 1B:
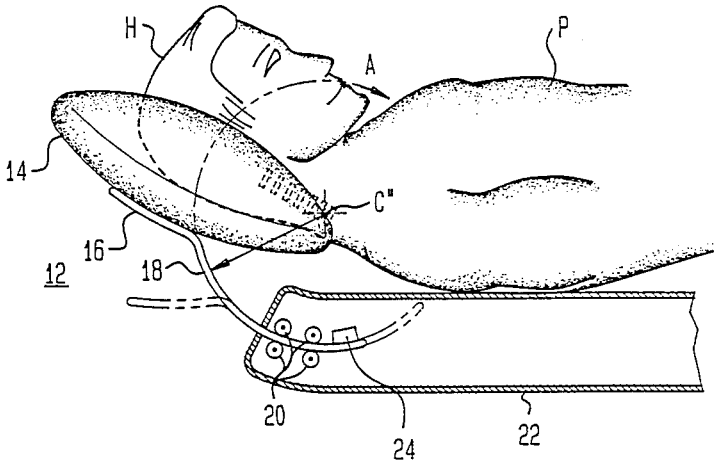
FIG. 1B (PRIOR ART)
Figure 2:
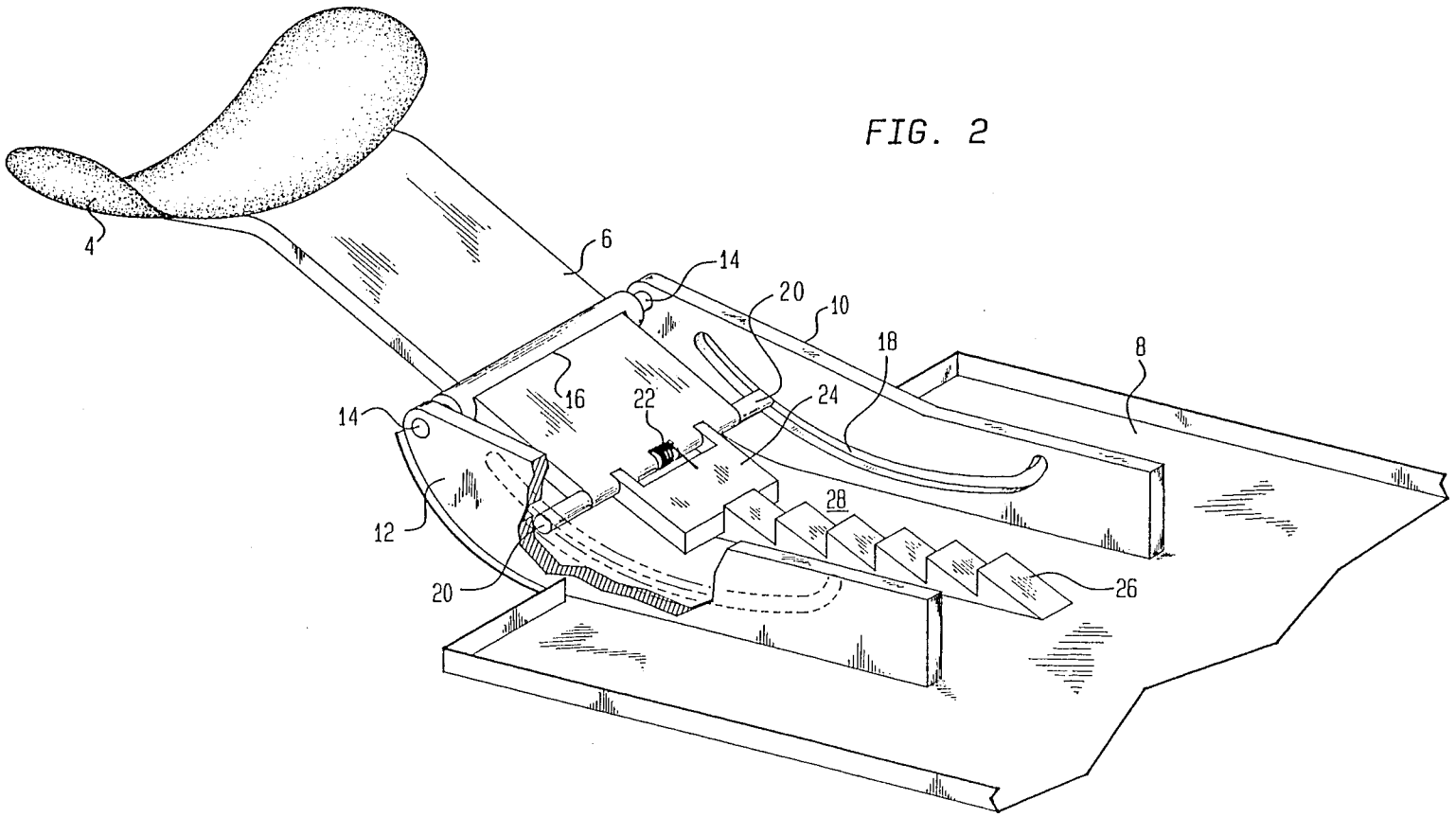
FIG. 2 shows a perspective view of a first embodiment of a headrest arrangements constructed in accordance with the principles of the present invention.
Figure 3:
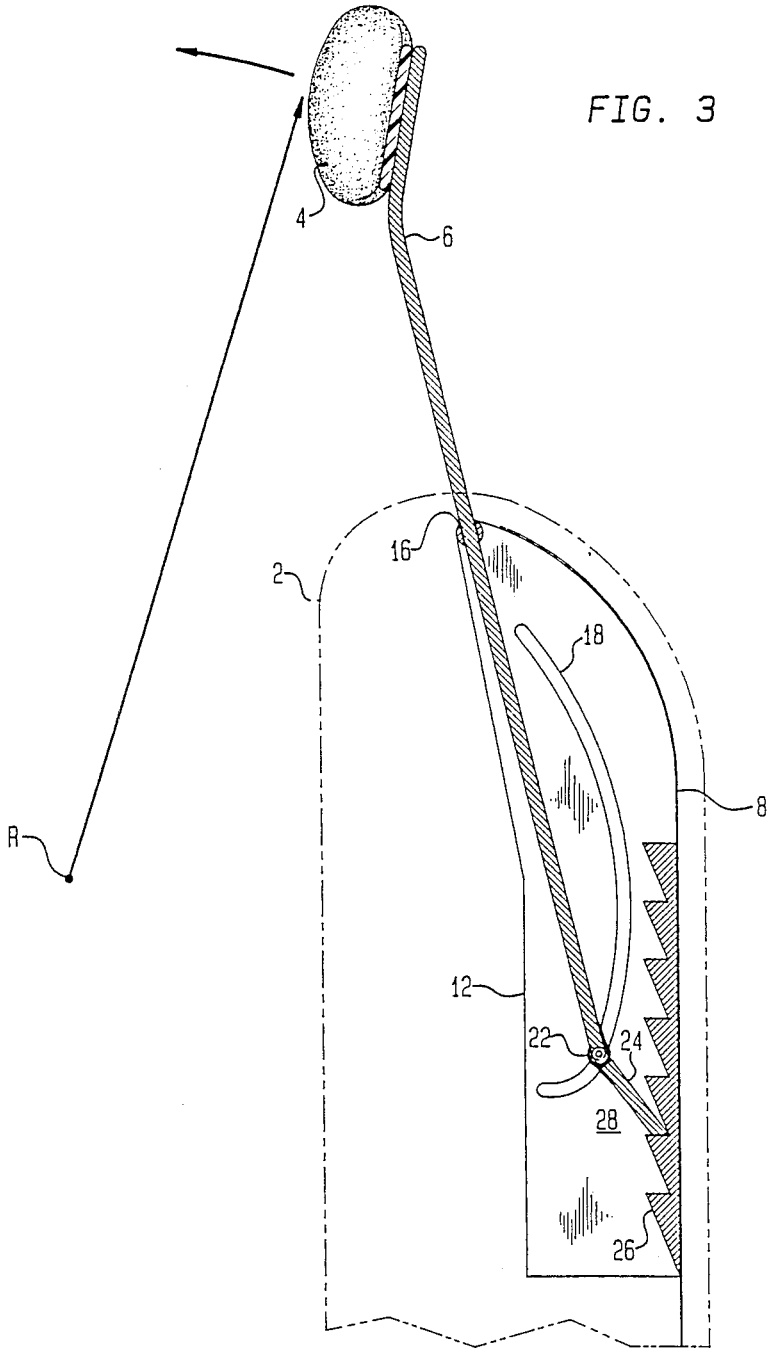
FIG. 3 is a cross-section view of the headrest arrangement of FIG. 2.

FIGS. 2 and 3 illustrate perspective and section views, respectively, of an embodiment of the headrest mechanism in the environment of a dental treatment chair. For purposes of clarity, the backrest portion 2 of the treatment chair (not totally shown) is shown in phantom without details of support, cushioning, etc., which details are not necessary for understanding the present invention.

A headrest pad 4 is attached to a first end of a sliding support bar 6 which extends out the top of backrest 2 and is slidable therein. Support bar 6 has a curved portion wherein headrest pad 4 is attached and a portion which extends into backrest 2. A mounting plate 8 secured within backrest 2 includes a support means for slidably positioning the other end of support bar 6 at various ones of a plurality of fixed positions. The support means comprises cam plates 10 and 12 secured in a parallel facing relationship on mounting plate 8 and separated by a rotatable pin 14 having its ends captivated by a portion of cam plates 10 and 12 which is located toward headrest 4. Pin 14 has a cross-slot 16 located therethrough, through which support bar 6 is able to slide through.

The facing sides of cam plates 10 and 12 include curved cam surfaces 18 therein, which slidably receive the ends of a cam following pin 20. Cam following pin 20 is secured near a second end of support bar 6 which is opposite its headrest end. A spring 22 associated with pin 20 urges a pawl 24 against a bar 26 having serrations therein which engage pawl 24 to form a ratchet locking mechanism 28 which locks the position of support bar 6 into any one of a plurality of positions defined by the serrations on bar 26. A release cable (not shown) having an end attached to pawl 24 is accessable from the headrest end of backrest 2 for selectively releasing lock mechanism 28 from its present position and thereby allow repositioning of support bar 6 with respect to cam plates 10 and 12.

In operation, support bar 6 slides through slot 16 in pin 14 as the position of headrest 4 is adjusted. Due to the confinement of the movement of the lower end of support bar 6 to a curved path defined by the action of cam following pin 20 along cam surfaces 18, headrest 4 moves in a curved path having a center of rotation R which is remote from the plane of mounting plate 8 and advantageously coincides with the center of rotation of the cervical vertebrae of a patient when disposed in the treatment chair. Thus, adjustment of the tilting angle of headrest 4 coincides with the normal angular movement of the patient's head and such adjustment is thereby accomplished without a sliding of the patient's head with respect to headrest 4.

Furthermore, in accordance with the present invention the curved surface which defines the tilting angle is located below the top of the chair back, thereby allowing the mechanical structure nearest the headrest to have a shape which will allow a maximum lowering of the patient's head towards the knees' of the dentist, thereby facilitating certain dental procedures.

Figure 4:
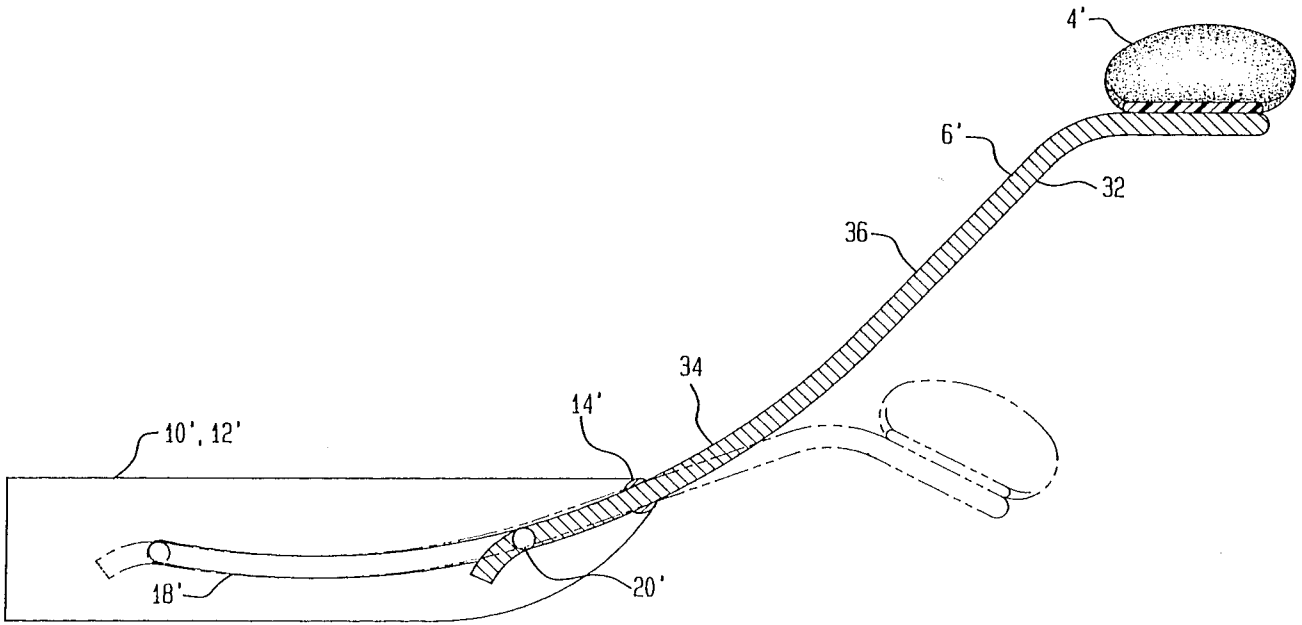
FIG. 4 is a cross-section view of a second embodiment of a headrest arrangement constructed according to the principles of the present invention.

FIG. 4 illustrates a second embodiment of the invention wherein a sigmoidally shaped headrest support bar allows the de of concavity of the cam following surface and the height of pin 14' to be reduce shown in the first embodiment, thereby even further reducing the thickness required for the headrest mechanism. Thus, the components and operation of the FIG. 4 embodiment are the same as described above with respect to FIGS. 2 and 3 (and accordingly use the same reference numerals, however, with a prime added) except that in FIG. 4, the concavely curved cam surfaces 18' have a lesser degree of concavity than the concavely curved cam surfaces 18 of FIGS. 2 and 3 and the height of pin 14' is reduced. This lesser degree of concavity and reduced height of pin 14' advantageously allows the height of support means 10' and 12' to be less than the height of support means 10 and 12 of the first embodiment; and therefore allows the backrest to be thinner and the patient's head to be positionable closer to the lap of the dentist. A raised and lowered position of the headrest is shown in FIG. 4 in solid lines and phantom, respectively.

In order to maintain as great a range of movement of the patient's head as with the first embodiment of the invention, and thereby compensate for the lesser degree of concavity of curved cam surfaces 18', support bar 6' has a sigmoidal shape. More specifically, a first portion 32 of bar 6' which is proximate headrest 4' has a concavity which is oppositely directed from the direction of the concavity of cam surfaces 18' (i.e., as shown in FIG. 4, the concavity of cam surfaces 18' is directed up while the concavity of portion 32 of bar 6' is substantially directed down). Furthermore, a second portion 34 of bar 6' which is proximate cam follower 20' has a concavity which is directed in substantially the same direction (up) as the concavity of cam surfaces 18'. Thus, bar 6' has oppositely directed concavities and an inflection point 36 therebetween.

Thus there has been shown and described novel apparatus for adjusting the tilting angle of a headrest which fulfills all the objects and advantages sought therefore. Many changes, modifications, variations and other uses and applications of the subject invention will, however, become apparent to those skilled in the art after considering this specification and the accompanying drawings which disclose only a preferred embodiment thereof. For example, although in the illustrated embodiments cam plates 10 and 12 are used, it is possible to use a single cam plate which is relatively thick so as to fully support pin 14 by only one end. Furthermore, instead of having bar 6 slide through a slot 16 in pin 14, bar 6 could have slots or grooves therein instead and pin 14 could engage these slots or grooves. Additionally, the headrest tilting arrangement can be used in a treatment table, as well as in a treatment chair. All such changes, modifications, variations and other uses and applications which do not depart from the spirit and scope of the invention are deemed to be covered by the invention which is limited only by the following claims.

What We claim is:

1. A device for controlling an angle of tilting of a headrest of a human treatment support, comprising:

a curved bar having first and second ends, with a headrest mounting portion proximate said first end;

support means including at least one curved cam surface and a guide means, said guide means slidably engaging a portion of said bar which is intermediate said first and second ends so as to allow said bar to be slidable with respect to said support means; and cam following means attached to said bar proximate said second end to for causing said second end to be engaged with and to follow said cam surface of said support means when said bar is slid with respect to said support means, thereby controlling the angle of tilting of said headrest mounting portion of said bar.

2. A device according to claim 1, wherein:

said curved bar is sigmoidally shaped.

3. A device according to claim 2, wherein:

said curved cam surface has a concavity oriented substantially in a first direction and said curved bar has a first concavity proximate said first end which is oriented substantially opposite said first direction and a concavity proximate said second end which is oriented substantially in said first direction, and having an inflection point between said first and second concavities.

4. A device according to claim 3, wherein:

said guide means comprises a pin having an end rotatably coupled to said support means, said pin having a cross-slot therethrough with a portion of said bar intermediate said first and second ends passing through and being slidable within said cross-slot.

5. A device according to claim 4, further including:

lock means attached to said bar proximate said second end for preventing sliding motion of said bar through said cross-slot.

6. A device according to claim 5, wherein:
said support means comprises a substantially flat mounting plate having first and second cam plates mounted thereon in a spaced apart and parallel relationship.

7. A device according to claim 6, wherein:
first and second ends of said pin are adapted to rotatably engage said first and second cam plates, respectively.

8. A device according to claim 7, wherein:
a facing side of each of said cam plates include an elongated curved slot for forming said curved cam surface.

9. A device according to claim 8, wherein:
said cam follower comprises a pin attached to said second end of said bar, opposite ends of said pin adapted for engaging and following said cam surfaces of said cam plates, respectively.

10. A device according to claim 1, wherein:
movement of said cam follower along said cam following surface causes said bar to slide with respect to said guide means and said first portion of said bar to move along a curved path having an origin which is remote from said support means so as to be located at approximately the origin of the locus of rotation of the head of a patient to be positioned on said human treatment support.

11. A dental chair having an adjustable headrest, comprising:
a chair backrest;
a mounting plate fixedly attached within said chair backrest;
a curved bar having first and second ends, with a headrest mounting portion proximate said first end;
support means coupled to said mounting plate and including a curved cam surface and a guide means coupled to said support means, said guide means slidably engaging a portion of said bar which is intermediate said first and second ends so as to allow said bar to be slidable with respect to said support means; and
cam following means attached to said bar proximate said second end for causing said second end to be engaged with and to follow said cam surface of said support means when said bar is slid with respect to said support means, thereby controlling the angle of tilting of said headrest mounting portion of said bar.

12. A device according to claim 11, wherein:
said curved bar is sigmoidally shaped.

13. A device according to claim 12, wherein:
said curved cam surface has a concavity oriented substantially in a first direction and said curved bar has a first concavity proximate said first end which is oriented substantially opposite said first direction and a concavity proximate said second end which is oriented substantially in said first direction, and having an inflection point between said first and second concavities.

14. A device according to claim 13, wherein:
said guide means comprises a pin having an end rotatably coupled to said support means, said pin having a cross-slot therethrough with a portion of said bar intermediate said first and second ends passing through and being slidable within said cross-slot.

15. A device according to claim 14, further including:
lock means attached to said bar proximate said second end for preventing sliding motion of said bar through said cross-slot.

16. A device according to claim 15, wherein:
said support means includes first and second cam plates mounted on a substantially flat mounting plate in a spaced apart and parallel facing relationship.

17. A device according to claim 16, wherein:
first and second ends of said pin are adapted to rotatably engage said first and second cam plates, respectively.

18. A device according to claim 17, wherein:
each of said cam plates include an elongated curved slot for forming said curved cam surface.

19. A device according to claim 18, wherein:
said cam follower comprises a pin attached to said second end of said bar, opposite ends of said pin adapted for engaging and following said cam surfaces of said cam plates, respectively.

20. A device according to claim 11, wherein:
movement of said cam follower along said cam following surface causes said bar to slide with respect to said guide means and said first portion of said bar to move along a curved path having an origin which is remote from said support means so as to be located at approximately the origin of the locus of rotation of the head of a patient to be positioned on said dental chair support.

* * * * *